US011657753B2

(12) United States Patent
Zheng

(10) Patent No.: US 11,657,753 B2
(45) Date of Patent: May 23, 2023

(54) VOLTAGE COMPENSATING CIRCUIT AND DISPLAY

(71) Applicant: CHONGQING KONKA PHOTOELECTRIC TECHNOLOGY RESEARCH INSTITUTE CO., LTD., Chongqing (CN)

(72) Inventor: Shisong Zheng, Chongqing (CN)

(73) Assignee: CHONGQING KONKA PHOTOELECTRIC TECHNOLOGY RESEARCH INSTITUTE CO., LTD., Chongqing (CN)

( * ) Notice: Subject to any disclaimer, the term of this patent is extended or adjusted under 35 U.S.C. 154(b) by 0 days.

(21) Appl. No.: 17/265,215

(22) PCT Filed: Jan. 20, 2020

(86) PCT No.: PCT/CN2020/073075
§ 371 (c)(1),
(2) Date: Feb. 2, 2021

(87) PCT Pub. No.: WO2021/142856
PCT Pub. Date: Jul. 22, 2021

(65) Prior Publication Data

US 2022/0343832 A1 Oct. 27, 2022

(30) Foreign Application Priority Data

Jan. 16, 2020 (CN) ..... 202010046618.7

(51) Int. Cl.
*G09G 3/30* (2006.01)

(52) U.S. Cl.
CPC ..... *G09G 3/30* (2013.01); *G09G 2300/0426* (2013.01); *G09G 2300/0842* (2013.01);
(Continued)

(58) Field of Classification Search
CPC ..... G09G 3/30; G09G 2300/0426; G09G 2300/0842; G09G 2310/06; G09G 2320/0233; G09G 2320/0626
See application file for complete search history.

(56) References Cited

U.S. PATENT DOCUMENTS

2017/0162120 A1* 6/2017 Hung ..... G09G 3/3258
2021/0335246 A1* 10/2021 Qu ..... G09G 3/3241

FOREIGN PATENT DOCUMENTS

CN 106782321 A 5/2017
CN 106910467 A 6/2017
(Continued)

*Primary Examiner* — Roy P Rabindranath
(74) *Attorney, Agent, or Firm* — Gang Yu

(57) ABSTRACT

The present application relates to a voltage compensating circuit and a display. The voltage compensating circuit includes: an electroluminescence device; a driving unit, used for driving the electroluminescence device; a luminescence time length control unit, respectively connected with the driving unit and the electroluminescence device, and used for controlling luminescence time length of the electroluminescence device; and a compensation unit, respectively connected with the driving unit and the luminescence time length control unit, and used for providing a compensation voltage to the voltage compensating circuit. Through the voltage compensating circuit in the present application, a dropped voltage value is compensated, thereby brightness uniformity of the display is improved, and image quality is improved.

10 Claims, 4 Drawing Sheets

(52) U.S. Cl.
CPC . *G09G 2310/06* (2013.01); *G09G 2320/0233* (2013.01); *G09G 2320/0626* (2013.01); *G09G 2330/021* (2013.01)

(56) References Cited

FOREIGN PATENT DOCUMENTS

| | | | |
|---|---|---|---|
| CN | 107967896 | A | 4/2018 |
| CN | 211350062 | U | 8/2020 |
| KR | 20150089476 | A | 8/2015 |

* cited by examiner

VOLTAGE COMPENSATING CIRCUIT AND DISPLAY

TECHNICAL FIELD

The present application relates to the technical field of electronic circuits, and in particular to a voltage compensating circuit and a display.

BACKGROUND

Electroluminescence (EL for short) devices, including an Organic Light Emitting Diode (OLED), a Light Emitting Diode (LED) and other devices, are widely used for manufacturing a display product in recent years. Compared with a traditional display (Cathode Ray Tube (CRT), Liquid Crystal Display (LCD) and the like), an application aspect thereof shows better optical characteristics, lower power consumption and better product morphological plasticity. Because the electroluminescence device is driven by a current, while used for manufacturing a display, it is matched with a typical Active Matrix (AM for short) or Passive Matrix (PM for short) driving method, due to a large electrical load caused by the current passing through a circuit and the EL device, an IR-drop problem is produced necessarily, this problem causes a drop of a voltage value, the voltage value is deviated from a supply voltage value of an original voltage source, and this problem directly causes a drop of a driving cross voltage of the EL device, so a current thereof flowing through the EL device is affected to be reduced, finally the brightness is reduced, it is reflected that Brightness Uniformity of a panel is reduced, and image quality of the display is greatly impacted.

Therefore, the related art needs to be improved.

SUMMARY

A technical problem to be solved by the present application is to provide a voltage compensating circuit, a dropped voltage value is compensated, thereby brightness uniformity of a display is improved, and image quality is improved.

In a first aspect, an embodiment of the present application provides a voltage compensating circuit, the circuit includes:

an electroluminescence device;

a driving unit, used for driving the electroluminescence device;

a luminescence time length control unit, respectively connected with the driving unit and the electroluminescence device, and used for controlling luminescence time length of the electroluminescence device; and a compensation unit, respectively connected with the driving unit and the luminescence time length control unit, and used for providing a compensation voltage to the voltage compensating circuit.

Optionally, a fixed current is input to the compensation unit through an external circuit, the compensation unit receives the fixed current and outputs a compensation voltage to the driving unit, the driving unit receives the compensation voltage and outputs a steady current to the electroluminescence device through the luminescence time length control unit to drive the electroluminescence device.

Optionally, a first reference voltage is input to the compensation unit, and the compensation unit adjusts the compensation voltage according to the first reference voltage.

Optionally, a second reference voltage is input to the compensation unit, so that the driving unit acquires an adjustable cross voltage, and outputs a steady current to the electroluminescence device through the luminescence time length control unit to drive the electroluminescence device.

Optionally, the compensation unit includes:

a second transistor, a third transistor, a fourth transistor, a fifth transistor and a capacitor.

A grid electrode of the fourth transistor is connected with a first signal control end, a source electrode of the fourth transistor is connected with the first reference voltage, and a drain electrode of the fourth transistor is connected with a first end of the capacitor; a second end of the capacitor is connected with a source electrode of the third transistor, a drain electrode of the third transistor is connected with a source electrode of the second transistor, and a drain electrode of the second transistor is connected with a fixed current input end; the first signal control end is further respectively connected with a grid electrode of the second transistor and a grid electrode of the third transistor.

A source electrode of the fifth transistor is connected with the second reference voltage, a drain electrode of the fifth transistor is connected with the first end of the capacitor, and a grid electrode of the fifth transistor is connected with a second signal control end (the grid electrode of the fifth transistor receives a second control signal).

Optionally, the driving unit includes:

a first transistor.

A grid electrode of the first transistor is connected with the second end of the capacitor, a source electrode of the first transistor is connected with a power source end, and a drain electrode of the first transistor is connected with a source electrode of a first switching transistor.

Optionally, the luminescence time length control unit includes:

the first switching transistor and a second switching transistor.

A source electrode of the first switching transistor is connected with the drain electrode of the first transistor, a drain electrode of the first switching transistor is connected with a source electrode of the second switching transistor, and a grid electrode of the first switching transistor is connected with the second signal control end; a source electrode of the second switching transistor is connected with a drain electrode of the first switching transistor, a drain electrode of the second switching transistor is connected with a positive electrode of the electroluminescence device, and a grid electrode of the second switching transistor is connected with a third signal control end; and a negative electrode of the electroluminescence device is grounded.

Optionally, the first signal control end is used for providing a first control signal, and the first control signal is used for controlling open-close of the second transistor, the third transistor and the fourth transistor.

Optionally, the second control end provides a second control signal, used for controlling open-close of the fifth transistor and the first switching transistor.

Optionally, the first transistor, the second transistor, the third transistor, the fourth transistor, the fifth transistor, the first switching transistor and the second switching transistor are all a P-type transistor.

Optionally, the compensation unit includes:

a second transistor, a third transistor, a fourth transistor, a fifth transistor and a capacitor.

A grid electrode of the fourth transistor is connected with a first signal control end, a source electrode of the fourth transistor is connected with the first reference voltage, and a drain electrode of the fourth transistor is connected with a first end of the capacitor; a second end of the capacitor is connected with a source electrode of the third transistor, a drain electrode of the third transistor is connected with a source electrode of the second transistor, and a drain electrode of the second transistor is connected with a fixed current input end; the first signal control end is further respectively connected with a grid electrode of the second transistor and a grid electrode of the third transistor.

A source electrode of the fifth transistor is connected with the second reference voltage, and a drain electrode of the fifth transistor is connected with the first end of the capacitor.

Optionally, the driving unit includes:

a first transistor.

A grid electrode of the first transistor is connected with the second end of the capacitor, a source electrode of the first transistor is connected with a drain electrode of a first switching transistor, and a source electrode of the first transistor is grounded.

Optionally, the luminescence time length control unit includes:

the first switching transistor and a second switching transistor.

A source electrode of the first switching transistor is connected with the drain electrode of the second switching transistor, a drain electrode of the first switching transistor is connected with the source electrode of the first transistor, and a grid electrode of the first switching transistor is connected with the second signal control end; a drain electrode of the second switching transistor is connected with a source electrode of the first switching transistor, a source electrode of the second switching transistor is connected with a negative electrode of the electroluminescence device, and a grid electrode of the second switching transistor is connected with a third signal control end; and a positive electrode of the electroluminescence device is connected with a power source end.

Optionally, the first transistor, the second transistor, the third transistor, the fourth transistor, the fifth transistor, the first switching transistor and the second switching transistor are all an N-type transistor.

In a second aspect, an embodiment of the present application provides a display, including: the display includes the above voltage compensating circuit.

Compared with the related art, the embodiments of the present application have the following advantages.

The voltage compensating circuit provided in accordance with an implementation mode of the present application includes an electroluminescence device; a driving unit, used for driving the electroluminescence device; a luminescence time length control unit, respectively connected with the driving unit and the electroluminescence device, and used for controlling luminescence time of the electroluminescence device; and a compensation unit, respectively connected with the driving unit and the luminescence time length control unit, and used for providing a compensation voltage to the voltage compensating circuit. Through the voltage compensating circuit in the present application, a dropped voltage value is compensated, thereby brightness uniformity of the display is improved, and image quality is improved.

BRIEF DESCRIPTION OF THE DRAWINGS

In order to more clearly describe technical schemes in embodiments of the present application or the related art, drawings which need to be used in description of the embodiments or the related art are briefly introduced below, it is apparent that the drawings as described below are only some of the embodiments described in the present application, and other drawings may also be acquired according to these drawings by those of ordinary skill in the art under a precondition without creative work.

DETAILED DESCRIPTION OF THE EMBODIMENTS

In order to make those skilled in the art better understand schemes of the present application, the technical schemes in embodiments of the present application are clearly and completely described below in combination with drawings in the embodiments of the present application. Apparently, the embodiments described are only part, rather than all, of the embodiments of the present application. Based on the embodiments in the present application, all other embodiments obtained by those of ordinary skill in the art under a precondition without creative work shall fall within the scope of protection of the present application.

It is discovered by the inventor through research that in an existing circuit design, under an AM or PM driving method of a typical EL display, an IR-drop (voltage drop) problem is produced due to a nature thereof, this problem causes a drop of a voltage value, the voltage value is deviated from a supply voltage value of an original voltage source, and this problem directly causes a drop of a driving cross voltage of the EL device, so a current thereof flowing through the EL device is affected to be reduced, finally the brightness is reduced, it is reflected that Brightness Uniformity of a panel is reduced, and image quality of the display is greatly impacted.

In order to solve the above problem, in the embodiments of the present application, a current signal is adjusted by using a fixed current input end, and the dropped voltage value thereof is compensated in combination with a pixel circuit architecture of 7 Transistors and 1 Capacitor (7T1C), so an External Compensation Circuit and System (ECCS) is achieved, the problem of the brightness uniformity of the display is improved, and the image quality is improved.

Each non-restrictive implementation mode of the present application is described in detail below with reference to the drawings.

Figure 1:
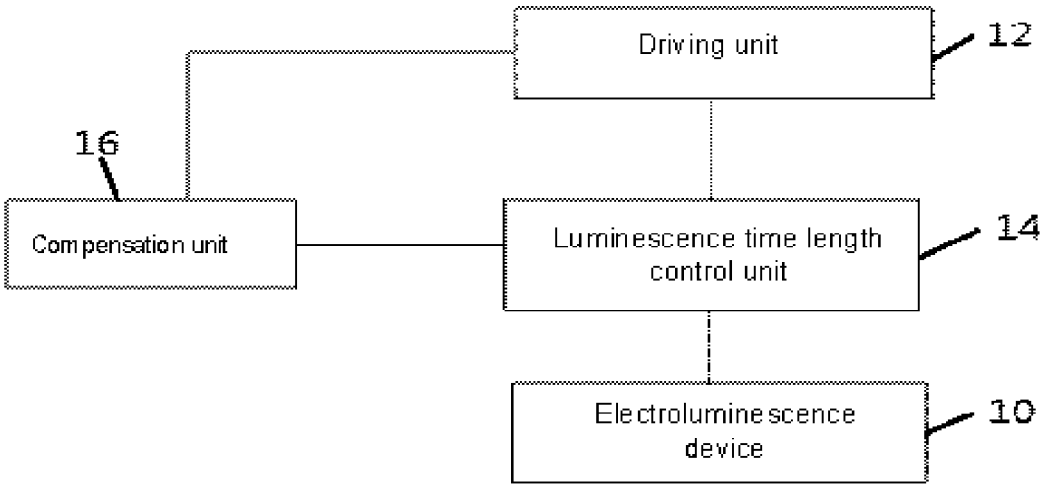
FIG. 1 is a structure schematic diagram of a voltage compensating circuit in an embodiment of the present application.

An embodiment of the present application provides a voltage compensating circuit, as shown in FIG. 1, the voltage compensating circuit includes: an electroluminescence device (EL device) 10;

a driving unit 12, used for driving the electroluminescence device 10;

a luminescence time length control unit 14, respectively connected with the driving unit 12 and the electroluminescence device 10, and used for controlling luminescence time length of the electroluminescence device; and a compensation unit 16, respectively connected with the driving unit 12 and the luminescence time length control unit 14, and used for providing a compensation voltage to the voltage compensating circuit.

The disclosure is capable of, through an external circuit, inputting a fixed current to the compensation unit 16, the compensation unit 16 receives the fixed current and outputs a compensation voltage to the driving unit 12, the driving unit 12 receives the compensation voltage and outputs a steady current to the electroluminescence device 10 through the luminescence time length control unit 14 to drive the electroluminescence device 10, a voltage drop caused by an electrical load is compensated by voltage compensation, thereby the problem of the brightness uniformity of the display is improved, and the image display quality is improved.

Figure 3:
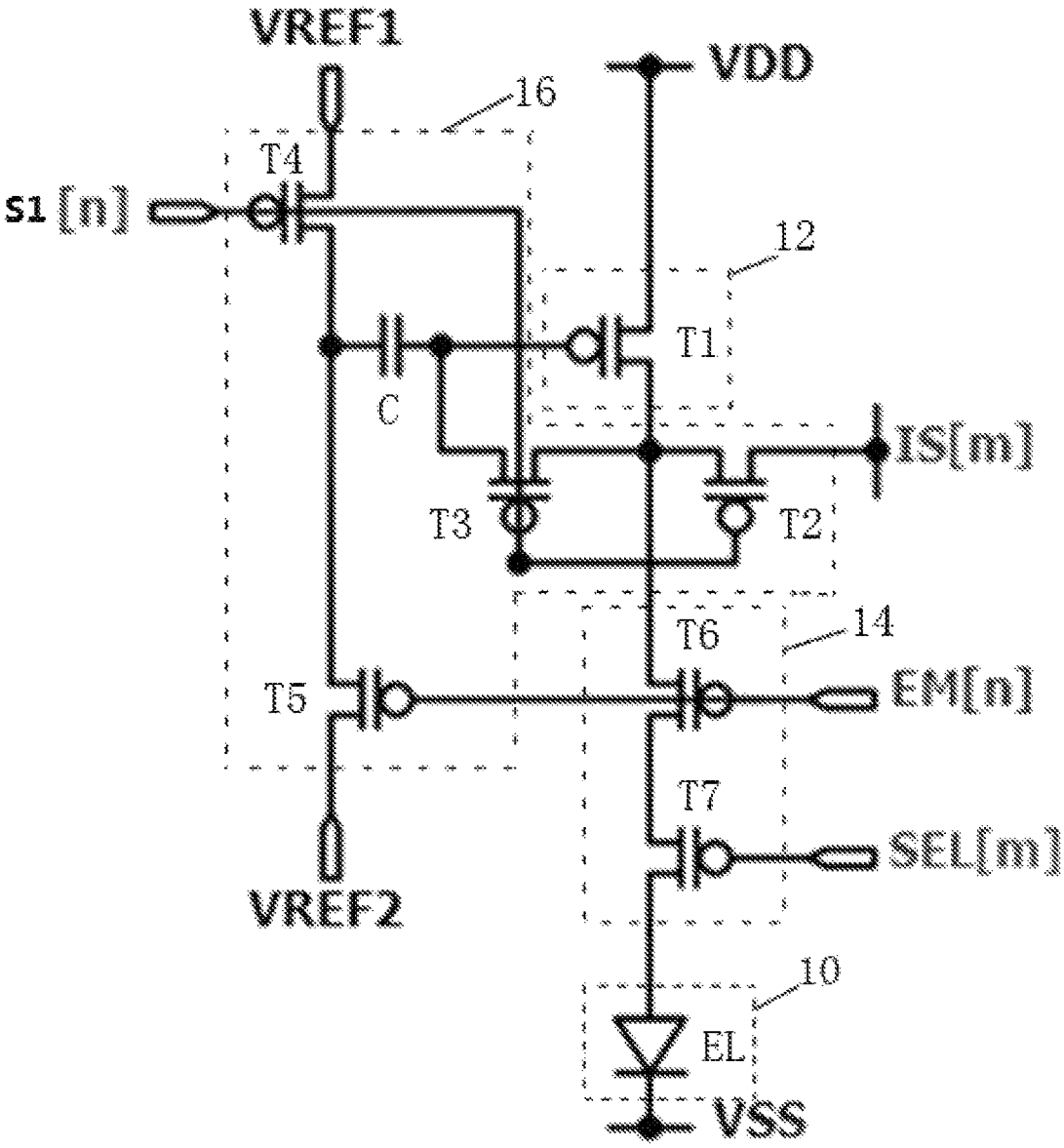
FIG. 3 is a structure schematic diagram of a p-type voltage compensating circuit in an embodiment of the present application.

Further, please refer to FIG. 3, through inputting a first reference voltage VREF1 to the compensation unit 16, the compensation unit 16 may adjust the compensation voltage according to the first reference voltage VREF1. Furthermore, through inputting a second reference voltage VREF2 to the compensation unit 16, so that the driving unit 12 acquires an adjustable cross voltage, and outputs a steady current to the electroluminescence device 10 through the luminescence time length control unit 14 to drive the electroluminescence device 10.

Figure 2:
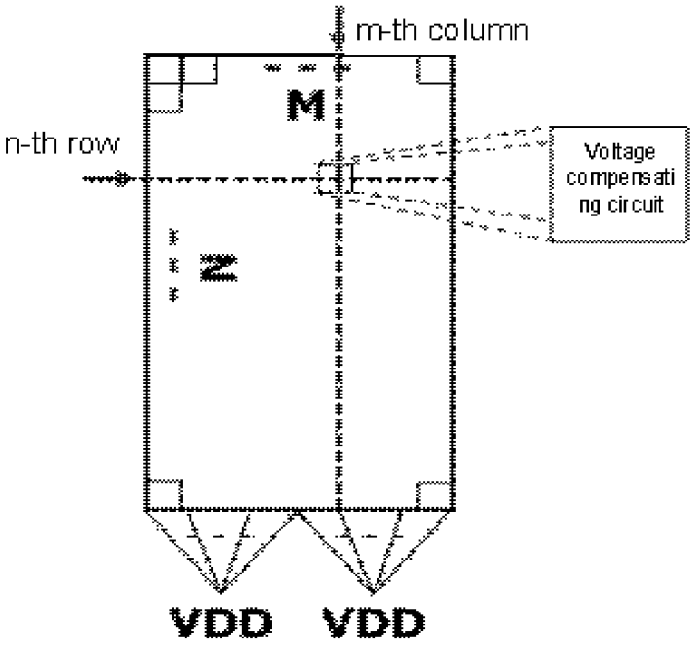
FIG. 2 is a schematic diagram of a voltage compensating circuit in an n-row m-column panel in an embodiment of the present application.

As shown in FIG. 2, a circuit architecture is established in n-th row and m-th column in a panel, a row control signal thereof is S1 and EM which are used for functional operations of the pixel circuit, and a column control signal thereof in a relative vertical direction is SEL which is served as a Pulse Width Modulation (PWM) functional signal for controlling the luminescence time of the EL device, a key IS signal provides an adjustable constant current signal, which is connected to an external circuit (usually connected to a DDIC/display driver chip), the ECCS is achieved, and the voltage drop problem caused by the IR-drop is Improved.

In an embodiment of the present application, there are two types of the voltage compensating circuits: a p-type and an n-type. The voltage compensating circuit includes 7 TFTs or an MOS active device includes 1 capacitor device and 3 circuit control signals, and IS[m] is an adjustable constant current signal. A circuit architecture of the n-type is compared with that of the p-type, a difference is that a connection position of the EL device is different from connection positions of other (including active and passive devices) devices.

If the type of the voltage compensating circuit is the p-type, the transistors in the circuit are a P-type transistor. As shown in FIG. 3, a connection mode of the voltage compensating circuit is as follows.

The compensation unit 16 includes:

a second transistor T2, a third transistor T3, a fourth transistor T4, a fifth transistor T5 and a capacitor C.

A grid electrode of the fourth transistor T4 is connected with a first signal control end (the grid electrode of the fourth transistor receives a first control signal S1), a source electrode of the fourth transistor T4 is connected with the first reference voltage VREF1, and a drain electrode of the fourth transistor T4 is connected with a first end of the capacitor C; a second end of the capacitor C is connected with a source electrode of the third transistor T3, a drain electrode of the third transistor T3 is connected with a source electrode of the second transistor T2, and a drain electrode of the second transistor T2 is connected with a fixed current input end (it is an adjustable constant current signal IS which is input by the fixed current input end); the first signal control end is further respectively connected with a grid electrode of the second transistor T2 and a grid electrode of the third transistor T3.

A source electrode of the fifth transistor T5 is connected with the second reference voltage VREF2, a drain electrode of the fifth transistor T5 is connected with the first end of the capacitor C, and a grid electrode of the fifth transistor T5 is connected with a second signal control end (the grid electrode of the fifth transistor receives a second control signal EM).

The driving unit 12 includes:

a first transistor T1.

A grid electrode of the first transistor T1 is connected with a second end of the capacitor C, a source electrode of the first transistor T1 is connected with a power source end (Voltage Drain Drain) VDD, and a drain electrode of the first transistor T1 is connected with a source electrode of a first switching transistor T6.

The luminescence time length control unit 14 includes:

a first switching transistor T6 and a second switching transistor T7.

A source electrode of the first switching transistor T6 is connected with a drain electrode of the first transistor T1, a drain electrode of the first switching transistor T6 is connected with a source electrode of the second switching transistor T7, and a grid electrode of the first switching transistor T6 is connected with the second signal control end (the grid electrode of the first switching transistor receives the second control signal EM); a source electrode of the second switching transistor T7 is connected with a drain electrode of the first switching transistor T6, a drain electrode of the second switching transistor T7 is connected with a positive electrode of the electroluminescence device EL, and a grid electrode of the second switching transistor is connected with a third signal control end (the grid electrode of the second switching transistor receives a third control signal SEL); and a negative electrode of the electroluminescence device EL is grounded VSS.

Specifically, the first transistor T1, the second transistor T2, the third transistor T3, the fourth transistor T4, the fifth transistor T5, the first switching transistor T6 and the second switching transistor T7 are all the P-type transistors.

Figure 4:
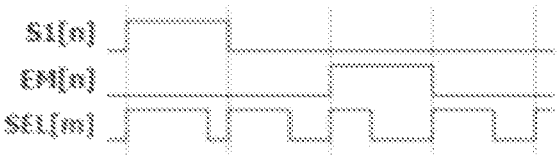
FIG. 4 is a signal waveform schematic diagram of the p-type voltage compensating circuit in an embodiment of the present application.

In order to better understand the disclosure, the voltage compensating circuit in the p-type is taken as an example, a working process thereof is described in combination with time sequence action, as shown in FIG. 4, FIG. 4 is a signal waveform schematic diagram of a p-type voltage compensating circuit, herein, the first control signal S1[*n*] (active low) is used for controlling open-close of the second transistor T2, the third transistor T3 and the fourth transistor T4, the second control signal EM[n] (active low) is used for controlling open-close of the fifth transistor T5 and the first switching transistor T6, the third control signal SEL[m] (normally closed) is a PWM function signal which is used for controlling the luminescence time of the EL device. Specifically, the time sequence action includes the following two stages.

Figure 5:
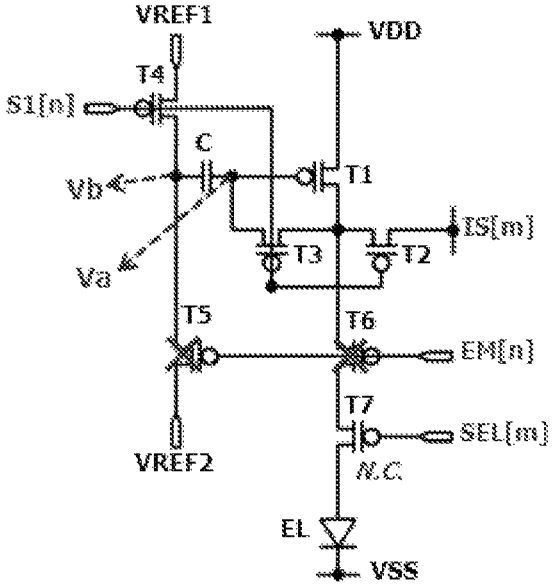
FIG. 5 is a structure schematic diagram of a first-stage voltage compensating circuit of the p-type voltage compensating circuit in an embodiment of the present application.
Figure 6:
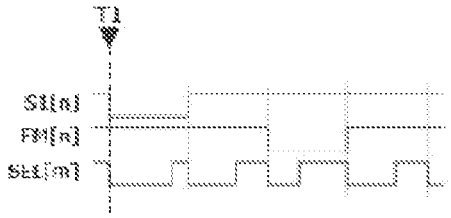
FIG. 6 is a first-stage signal waveform schematic diagram of the p-type voltage compensating circuit in an embodiment of the present application.

First stage: please refer to FIG. 5 and FIG. 6, in the first stage, namely a moment T1, because the first control signal S1 is a low level (active low), the first transistor T1, the second transistor T2, the third transistor T3 and the fourth transistor T4 are located in an open-state, and because the second control signal EM is a high level, the fifth transistor T5 and the sixth transistor T6 are located in an off-state ("x" in FIG. 6 represents a close-state). The disclosure is connected to the external circuit through the IS[m] (first control signal), and an adjustable fixed current source is provided to determine a Vgs voltage value of the first transistor T1, a compensation function is achieved. Because a power source end VDD participates in this current path, this voltage value achieves a purpose of compensating the voltage drop caused by the IR-drop. More specifically, a relation between various nodes may be represented by the following formulas.

$Va=VDD-Vth-VIS$: the compensation voltage is written, and $VIS$ is determined by a current size of the $IS[m]$.

$Vb$=VREF1: it is pulled to a reference fixed potential, which may be used as a function for adjusting a current output size.

Figure 7:
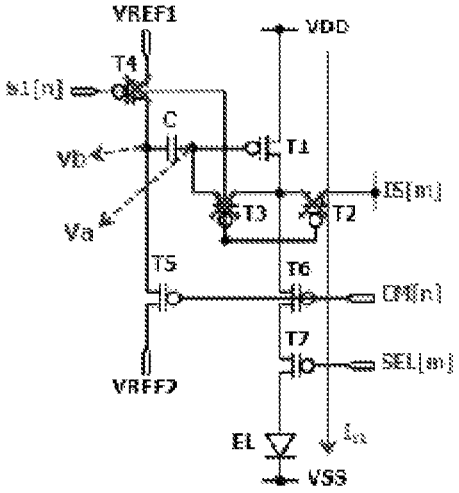
FIG. 7 is a structure schematic diagram of a second-stage voltage compensating circuit of the p-type voltage compensating circuit in an embodiment of the present application.
Figure 8:
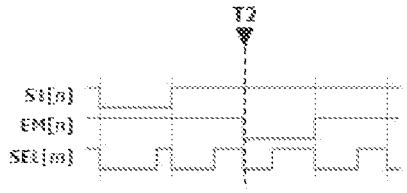
FIG. 8 is a second-stage signal waveform schematic diagram of the p-type voltage compensating circuit in an embodiment of the present application.

Second stage: as shown in FIG. 7 and FIG. 8, in the second stage, namely a moment T2, because the first control signal S1 is the high level, the first transistor T1, the second transistor T2, the third transistor T3 and the fourth transistor T4 are located in the off-state, and because the second control signal EM is the low level, the fifth transistor T5 and the sixth transistor T6 are located in the open-state. The disclosure is capable of, through writing the second reference voltage VREF2, and coupling the capacitor C, enabling the first transistor T1 to obtain an adjustable cross voltage, so that the first transistor T1 may output a steady current, as to achieve the luminescence brightness required by the EL device, and the second switching transistor T7 is served as a time controller for controlling the current to pass through the EL device, corresponding to the luminescence brightness and gray scale. More specifically, the relation between the various nodes may be represented by the following formulas.

$Va=VDD-Vth-VIS+$(VREF2−VREF1), a compensation voltage value output finally.

$Vb$=VREF2, a voltage difference from the VREF1 to the VREF2 is coupled to the $T1$ through the $C$.

Finally, $IEL=k\times(VDD-Va-Vth)^2=k\times(VIS+VREF1-VREF2)^2$, there is no parameter factor of VDD in this formula, so it is not affected by a VDD voltage drop, and compensation current output is completed.

Figure 9:
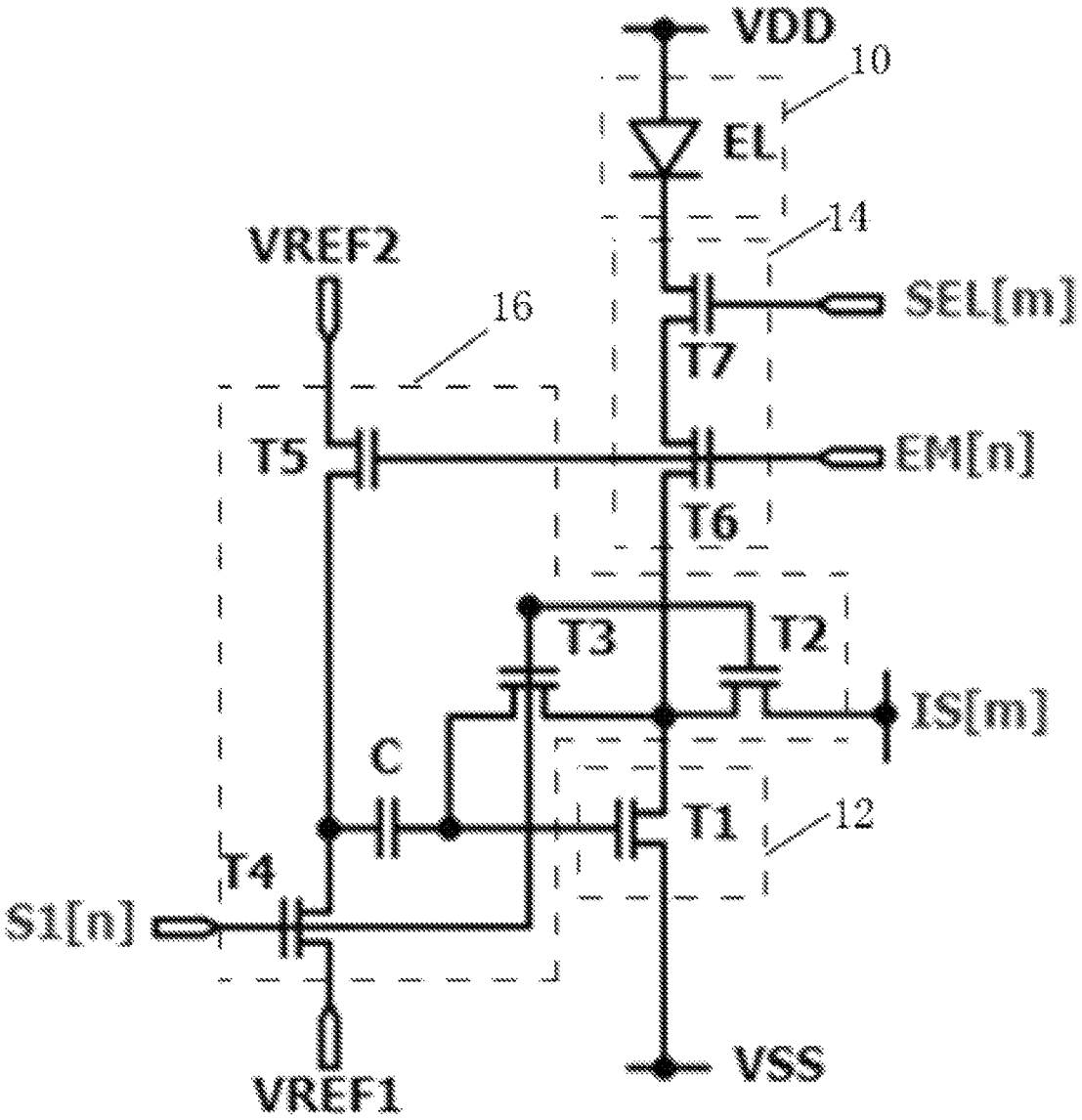
FIG. 9 is a structure schematic diagram of an n-type voltage compensating circuit in an embodiment of the present application.

If the type of the voltage compensating circuit is the n-type, the transistors in the circuit are a N-type transistor, namely the first transistor T1, the second transistor T2, the third transistor T3, the fourth transistor T4, the fifth transistor T5, the first switching transistor T6 and the second switching transistor T7 are all the N-type transistor. As shown in FIG. 9, a connection mode of the voltage compensating circuit is as follows.

The compensation unit 16 includes:

a second transistor T2, a third transistor T3, a fourth transistor T4, a fifth transistor T5 and a capacitor C.

A grid electrode of the fourth transistor T4 is connected with a first signal control end (the grid electrode of the fourth transistor receives the first control signal S1), a source electrode of the fourth transistor T4 is connected with the first reference voltage VREF1, and a drain electrode of the fourth transistor T4 is connected with a first end of the capacitor C; a second end of the capacitor C is connected with a source electrode of the third transistor T3, a drain electrode of the third transistor T3 is connected with a source electrode of the second transistor T2, and a drain electrode of the second transistor T2 is connected with a fixed current input end (it is an adjustable constant current signal IS which is input by the fixed current input end); the first signal control end is further respectively connected with a grid electrode of the second transistor T2 and a grid electrode of the third transistor T3.

A source electrode of the fifth transistor T5 is connected with the second reference voltage VREF2, and a drain electrode of the fifth transistor T5 is connected with the first end of the capacitor C.

The driving unit 12 includes:

a first transistor T1.

A grid electrode of the first transistor T1 is connected with a second end of the capacitor C, a source electrode of the first transistor T1 is connected with a drain electrode of a first switching transistor T6, and a source electrode of the first transistor T1 is grounded.

The luminescence time length control unit 14 includes:

a first switching transistor T6 and a second switching transistor T7.

A source electrode of the first switching transistor T6 is connected with a drain electrode of the second switching transistor T7, a drain electrode of the first switching transistor T6 is connected with a source electrode of the first transistor T1, and a grid electrode of the first switching transistor T6 is connected with the second signal control end (the grid electrode of the first switching transistor receives the second control signal EM); a drain electrode of the second switching transistor T7 is connected with a source electrode of the first switching transistor T6, a source electrode of the second switching transistor T7 is connected with a negative electrode of the electroluminescence device EL, and a grid electrode of the second switching transistor T7 is connected with a third signal control end (the grid electrode of the second switching transistor receives the third control signal SEL); and a positive electrode of the electroluminescence device EL is connected with a power source end VDD.

Based on the typical display driving method and circuit design, because a common power source is used, pixels in a display area, except for pixels on an edge of the panel, are powered by direct wiring of the circuit, and while the EL device is operated for the luminescence, the large electrical load provided causes that pixel points in the display area may produce the different voltage drops, it is reflected that the bright is directly reduced, and the brightness uniformity is deteriorated.

In the voltage compensating circuit of the present application, the IS[m] is used to adjust the current signal, and the dropped voltage value thereof is compensated by the pixel circuit architecture in combination with the 7T1C (7 Transistors and 1 Capacitor), the ECCS is achieved, the problem of the brightness uniformity of the display is solved, and the image quality is improved.

The present application provides a display, and the display includes the above voltage compensating circuit.

Each technical feature of the above embodiments may be arbitrarily combined. In order to describe simply and clearly, all possible combinations of each technical feature in the above embodiments are not described, however, as long as there is no contradiction in the combinations of these technical features, it should be considered as a scope described in the description.

The above embodiments only represent several implementation modes of the present application, the description thereof is relatively specific and detailed, but it should not be understood as limitation to the scope of the disclosure. It should be pointed out that under a precondition without departing from a concept of present application, a plurality of modifications and improvements may also be made by those of ordinary skill in the art, and these all fall within the scope of protection of the present application. Therefore, the scope of protection of the present application patent shall be subject to the appended claims.

What is claimed is:

1. A voltage compensating circuit, comprising:

an electroluminescence device;

a driving unit, used for driving the electroluminescence device;

a luminescence time length control unit, respectively connected with the driving unit and the electroluminescence device, and used for controlling luminescence time length of the electroluminescence device; and a compensation unit, respectively connected with the driving unit and the luminescence time length control unit, and used for providing a compensation voltage to the voltage compensating circuit, wherein a fixed current is input to the compensation unit through an external circuit, the compensation unit receives the fixed current and outputs a compensation voltage to the driving unit, the driving unit receives the compensation voltage and outputs a steady current to the electroluminescence device through the luminescence time length control unit to drive the electroluminescence device, wherein a second reference voltage is input to the compensation unit, so that the driving unit acquires an adjustable cross voltage, and outputs a steady current to the electroluminescence device through the luminescence time length control unit to drive the electroluminescence device, wherein the compensation unit comprises:

a second transistor, a third transistor, a fourth transistor, a fifth transistor and a capacitor;

wherein a grid electrode of the fourth transistor is connected with a first signal control end, a source electrode of the fourth transistor is connected with the first reference voltage, and a drain electrode of the fourth transistor is connected with a first end of the capacitor; a second end of the capacitor is connected with a source electrode of the third transistor, a drain electrode of the third transistor is connected with a source electrode of the second transistor, and a drain electrode of the second transistor is connected with a fixed current input end; the first signal control end is further respectively connected with a grid electrode of the second transistor and a grid electrode of the third transistor; and a source electrode of the fifth transistor is connected with the second reference voltage, a drain electrode of the fifth transistor is connected with the first end of the capacitor, and a grid electrode of the fifth transistor is connected with a second signal control end, or wherein the compensation unit comprises:

a second transistor, a third transistor, a fourth transistor, a fifth transistor and a capacitor;

wherein a grid electrode of the fourth transistor is connected with a first signal control end, a source electrode of the fourth transistor is connected with the first reference voltage, and a drain electrode of the fourth transistor is connected with a first end of the capacitor; a second end of the capacitor is connected with a source electrode of the third transistor, a drain electrode of the third transistor is connected with a source electrode of the second transistor, and a drain electrode of the second transistor is connected with a fixed current input end; the first signal control end is further respectively connected with a grid electrode of the second transistor and a grid electrode of the third transistor; and a source electrode of the fifth transistor is connected with the second reference voltage, and a drain electrode of the fifth transistor is connected with the first end of the capacitor.

2. The voltage compensating circuit as claimed in claim 1, wherein a first reference voltage is input to the compensation unit, and the compensation unit adjusts the compensation voltage according to the first reference voltage.

3. A display, comprising the voltage compensating circuit as claimed in claim 2.

4. The voltage compensating circuit as claimed in claim 1, wherein the driving unit comprises:

a first transistor;

wherein a grid electrode of the first transistor is connected with the second end of the capacitor, a source electrode of the first transistor is connected with a power source end, and a drain electrode of the first transistor is connected with a source electrode of a first switching transistor.

5. The voltage compensating circuit as claimed in claim 4, wherein the luminescence time length control unit comprises:

the first switching transistor and a second switching transistor;

a source electrode of the first switching transistor is connected with the drain electrode of the first transistor, a drain electrode of the first switching transistor is connected with a source electrode of the second switching transistor, and a grid electrode of the first switching transistor is connected with the second signal control end; a source electrode of the second switching transistor is connected with a drain electrode of the first switching transistor, a drain electrode of the second switching transistor is connected with a positive electrode of the electroluminescence device, and a grid electrode of the second switching transistor is connected with a third signal control end; and a negative electrode of the electroluminescence device is grounded.

6. A display, comprising the voltage compensating circuit as claimed in claim 5.

7. A display, comprising the voltage compensating circuit as claimed in claim 4.

8. The voltage compensating circuit as claimed in claim 1, wherein the driving unit comprises:

a first transistor;

wherein a grid electrode of the first transistor is connected with the second end of the capacitor, a source electrode of the first transistor is connected with a drain electrode of a first switching transistor, and a drain electrode of the first transistor is grounded; and the luminescence time length control unit comprises:

the first switching transistor and a second switching transistor;

a source electrode of the first switching transistor is connected with the drain electrode of the second switching transistor, a drain electrode of the first switching transistor is connected with the source electrode of the first transistor, and a grid electrode of the first switching transistor is connected with the second signal control end; a drain electrode of the second switching transistor is connected with a source electrode of the first switching transistor, a source electrode of the second switching transistor is connected with a negative electrode of the electroluminescence device, and a grid electrode of the second switching transistor is connected with a third signal control end; and a positive electrode of the electroluminescence device is connected with a power source end.

9. A display, comprising the voltage compensating circuit as claimed in claim 8.

10. A display, comprising the voltage compensating circuit as claimed in claim 1.

* * * * *